US011813637B1

(12) United States Patent
Petras

(10) Patent No.: US 11,813,637 B1
(45) Date of Patent: Nov. 14, 2023

(54) PAINTING SUPPORT ASSEMBLY

(71) Applicant: David Petras, Tustin, CA (US)

(72) Inventor: David Petras, Tustin, CA (US)

( * ) Notice: Subject to any disclaimer, the term of this patent is extended or adjusted under 35 U.S.C. 154(b) by 0 days.

(21) Appl. No.: 17/725,314

(22) Filed: Apr. 20, 2022

(51) Int. Cl.
*B05C 13/02* (2006.01)

(52) U.S. Cl.
CPC ..... *B05C 13/02* (2013.01)

(58) Field of Classification Search
USPC ..... 118/503
See application file for complete search history.

(56) References Cited

U.S. PATENT DOCUMENTS 2,019,214 A * 10/1935 Denny ..... A47B 97/08 248/449
2,763,301 A * 9/1956 Christopherson ..... B25H 1/10 144/287
3,632,101 A 1/1972 Ross
3,920,213 A * 11/1975 Hanson, Jr. ..... A47B 97/04 248/455
4,690,363 A * 9/1987 Koves ..... A47B 97/08 248/163.1
5,090,648 A * 2/1992 Wood, IV ..... B05B 13/0285 269/208
5,551,980 A 9/1996 Turnbo
5,660,637 A * 8/1997 Dodge ..... B05B 13/0285 211/208
5,707,450 A * 1/1998 Thompson ..... B05B 13/0285 118/500
6,024,348 A 2/2000 Ventura
6,036,779 A * 3/2000 Tolbert ..... B05B 13/0285 118/500
6,090,204 A * 7/2000 Speed ..... B05B 13/0285 118/500
6,109,600 A * 8/2000 Yost ..... B66C 23/48 269/95
6,158,701 A * 12/2000 Deshler ..... F16M 11/28 248/125.1
6,409,128 B1 * 6/2002 Deshler ..... B05B 13/0285 248/125.1
6,702,130 B1 * 3/2004 Carlilse ..... B05B 13/0285 269/53
6,837,934 B1 * 1/2005 Patrykus ..... F16M 11/043 248/124.2
7,077,365 B2 * 7/2006 Vincak ..... B05B 13/0285 248/122.1
7,380,765 B2 * 6/2008 Shiff ..... A47B 97/04 248/460

(Continued)

FOREIGN PATENT DOCUMENTS

WO WO2015149150 10/2015

*Primary Examiner* — Jethro M. Pence

(57) ABSTRACT

A painting support assembly includes a tripod and a mounting block that is coupled to the tripod. The mounting block has a pair of channels integrated into the mounting block. A pair of extension blocks is provided and each of the extension blocks has an engagement which slidably engages a respective one of the channels in the mounting block. In this way the overall width of the mounting block is increased to support a small panel in a horizontal position for painting. A plate is positionable on top of the extension blocks and the mounting block and plate includes grips which engage the extension blocks. The plate supports a large panel in a horizontal position to facilitate painting the large panel.

13 Claims, 6 Drawing Sheets

(56) References Cited

U.S. PATENT DOCUMENTS

| | | | | |
|---|---|---|---|---|
| 7,448,606 | B1 * | 11/2008 | Johnson | B05B 13/0285 269/16 |
| 7,753,169 | B1 * | 7/2010 | Kurtz | E06C 1/397 182/17 |
| 7,870,834 | B1 | 1/2011 | Cundiff | |
| 8,328,173 | B1 * | 12/2012 | DesForge | B62B 3/04 248/176.1 |
| 9,393,647 | B2 * | 7/2016 | Gagnon | B23P 6/00 |
| 10,661,295 | B2 | 5/2020 | Robinson | |
| 10,730,340 | B2 | 8/2020 | McGory | |
| 10,744,526 | B2 * | 8/2020 | Johnson | B25H 1/00 |
| 2008/0067311 | A1 * | 3/2008 | Wagner | B25H 1/02 248/276.1 |
| 2009/0184217 | A1 * | 7/2009 | Sprout | B25H 1/0007 280/35 |
| 2018/0345716 | A1 * | 12/2018 | McGrory | B44D 3/125 |
| 2018/0361417 | A1 | 12/2018 | Alayon | |
| 2020/0122179 | A1 * | 4/2020 | Robinson | B05B 13/0285 |

* cited by examiner

PAINTING SUPPORT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to support devices and more particularly pertains to a new support device for supporting a panel in a horizontal orientation for painting. The device includes a tripod and a mounting block attached to the tripod. A pair of extension blocks is included and each of the extension blocks is attachable to the mounting block for supporting a small panel in a horizontal orientation. The device includes a plate that is attachable to the mounting block and the extension blocks for supporting a large panel in a horizontal orientation.

(2) Description of Related Art including information disclosed under 37 CFR 1.97 and 1.98.

The prior art relates to support devices including a variety of panel holder devices that each includes a tripod and a gripping mechanism attached to the tripod for gripping a panel and positioning the panel in a vertical orientation. The prior art discloses a painter's stand device that includes a pair of stands that each pivotally engages a respective end of a door such that the door is rotatable about a horizontal axis for painting. The prior art discloses a tripod kit that includes a plurality of tripods, each including a stanchion with an upper end, and which are all positionable to facilitate the top end of the stanchion of each of the tripods to support a panel in a horizontal orientation.

BRIEF SUMMARY OF THE INVENTION

An embodiment of the disclosure meets the needs presented above by generally comprising a tripod and a mounting block that is coupled to the tripod. The mounting block has a pair of channels integrated into the mounting block. A pair of extension blocks is provided and each of the extension blocks has an engagement which slidably engages a respective one of the channels in the mounting block. In this way the overall width of the mounting block is increased to support a small panel in a horizontal position for painting. A plate is positionable on top of the extension blocks and the mounting block and plate includes grips which engage the extension blocks. The plate supports a large panel in a horizontal position to facilitate painting the large panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
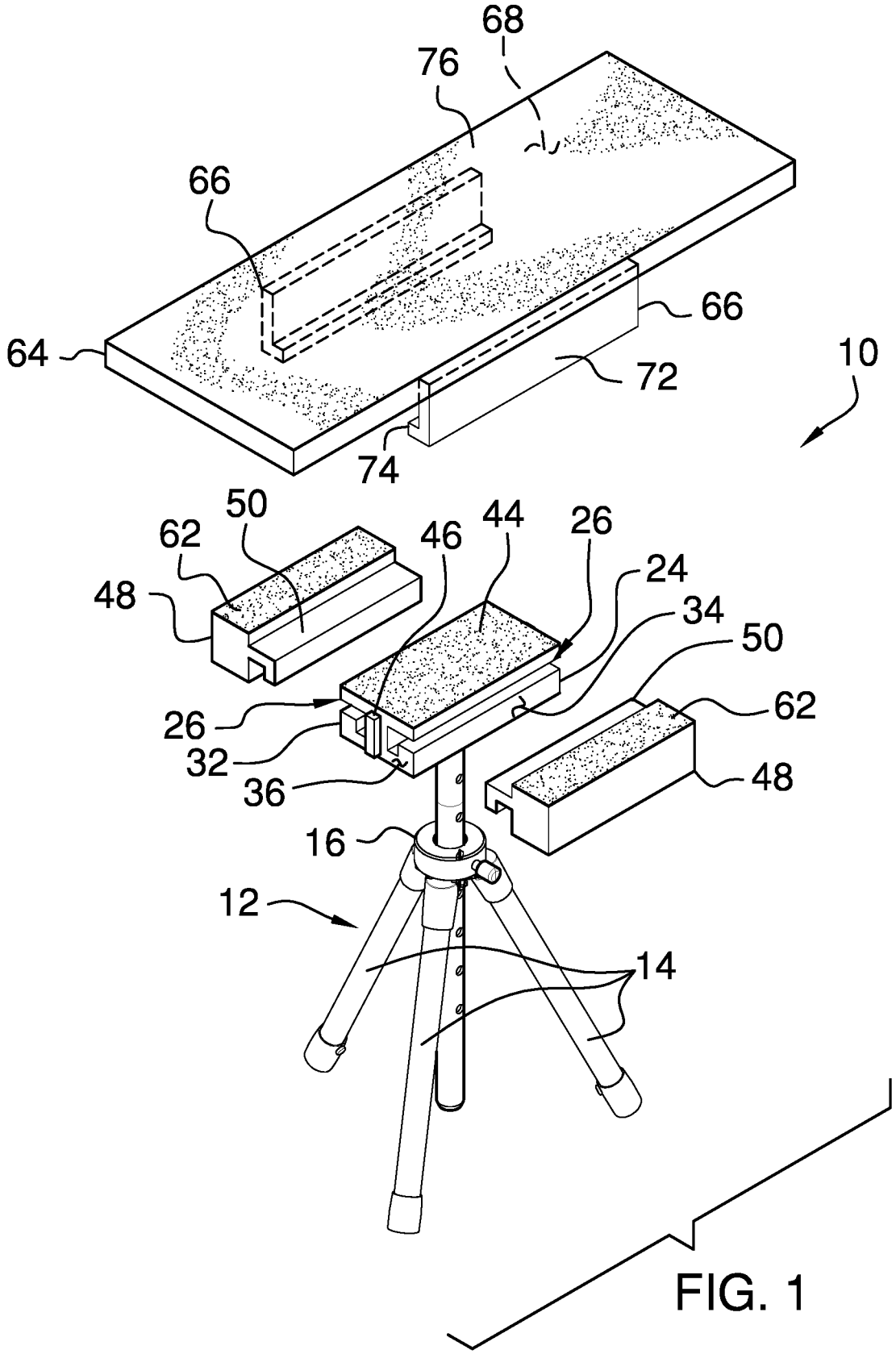
FIG. 1 is an exploded top perspective view of a painting support assembly according to an embodiment of the disclosure.
Figure 2:
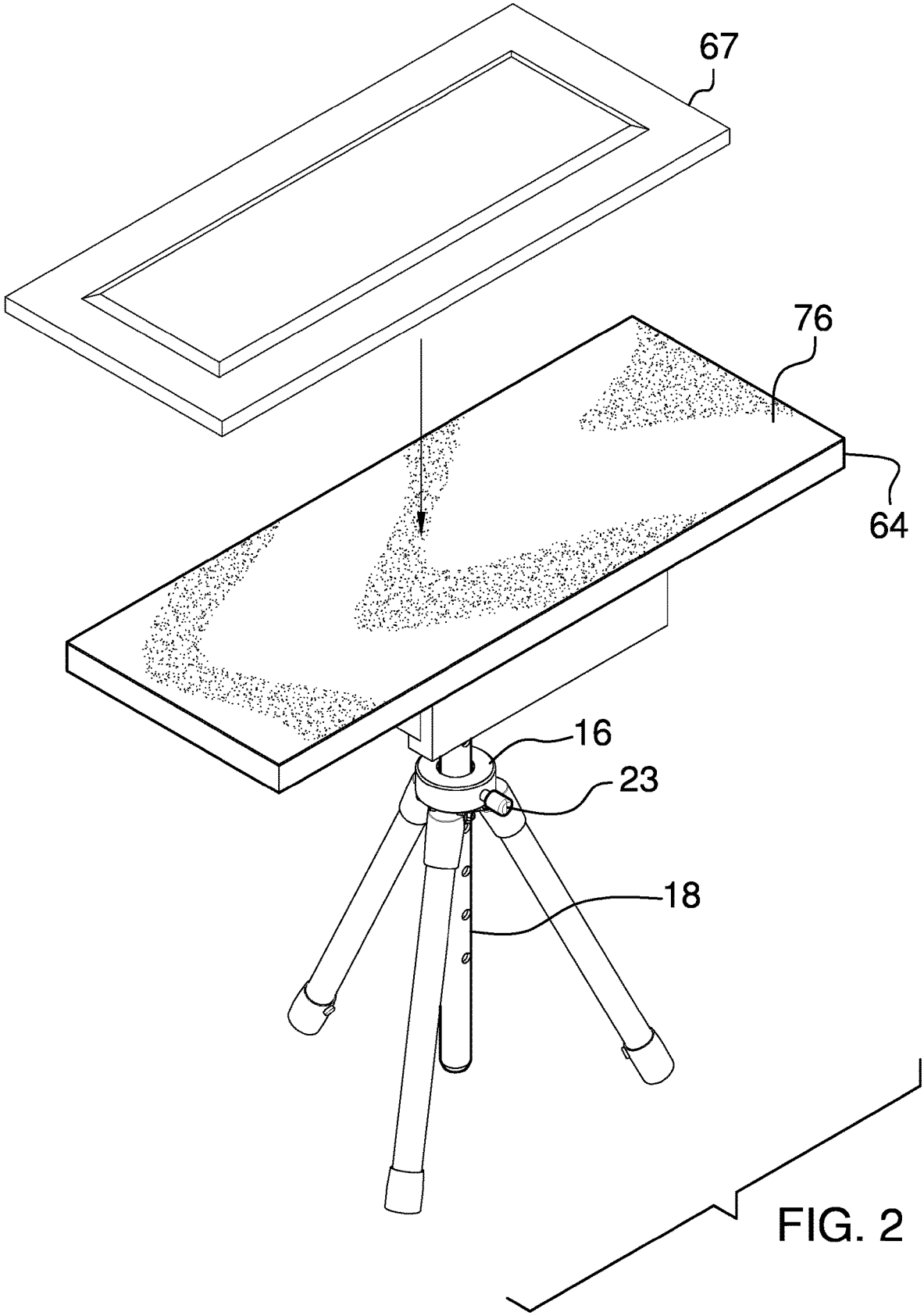
FIG. 2 is a perspective in-use view of an embodiment of the disclosure showing a large panel being positioned on a plate.
Figure 3:
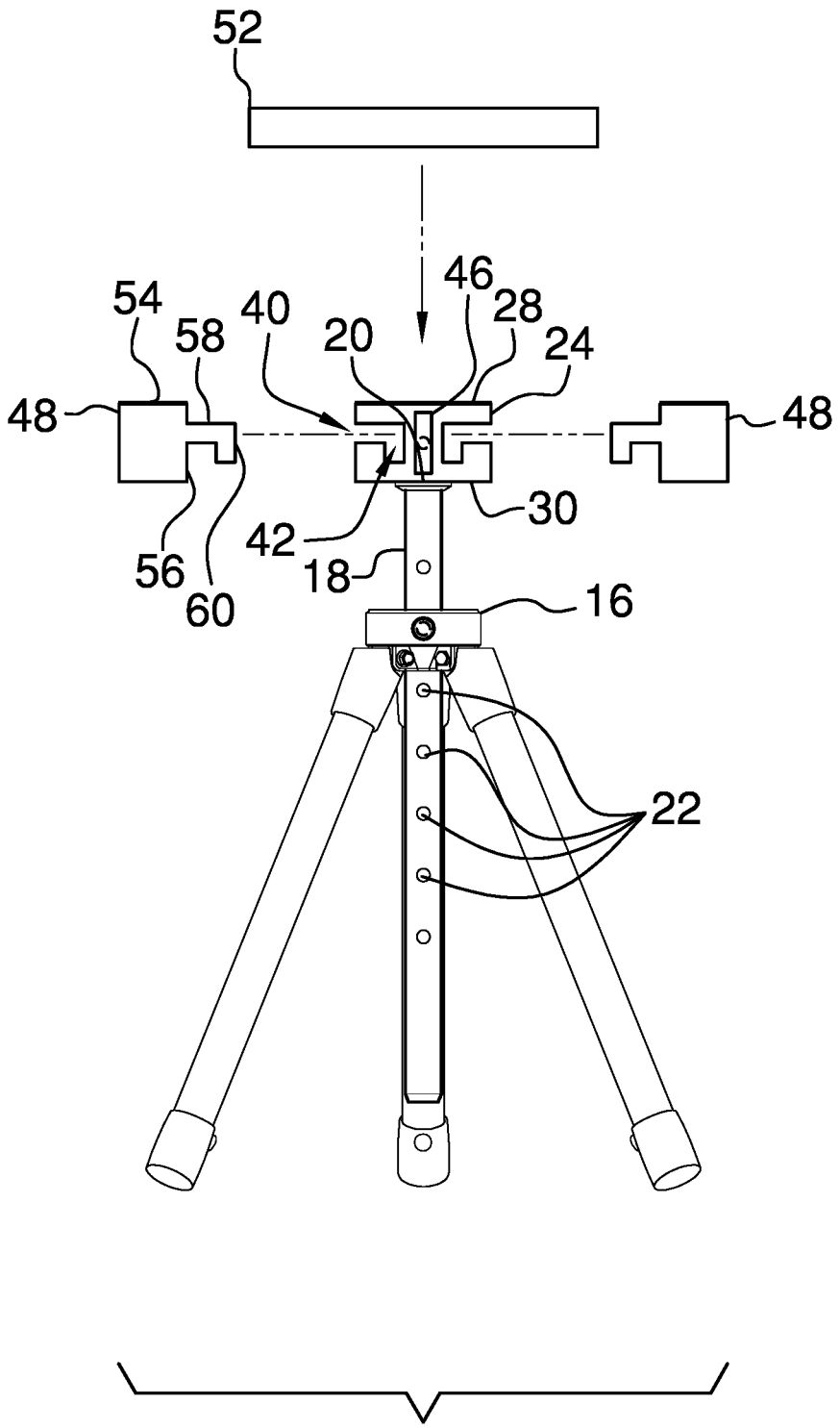
FIG. 3 is a front exploded view of an embodiment of the disclosure.
Figure 4:
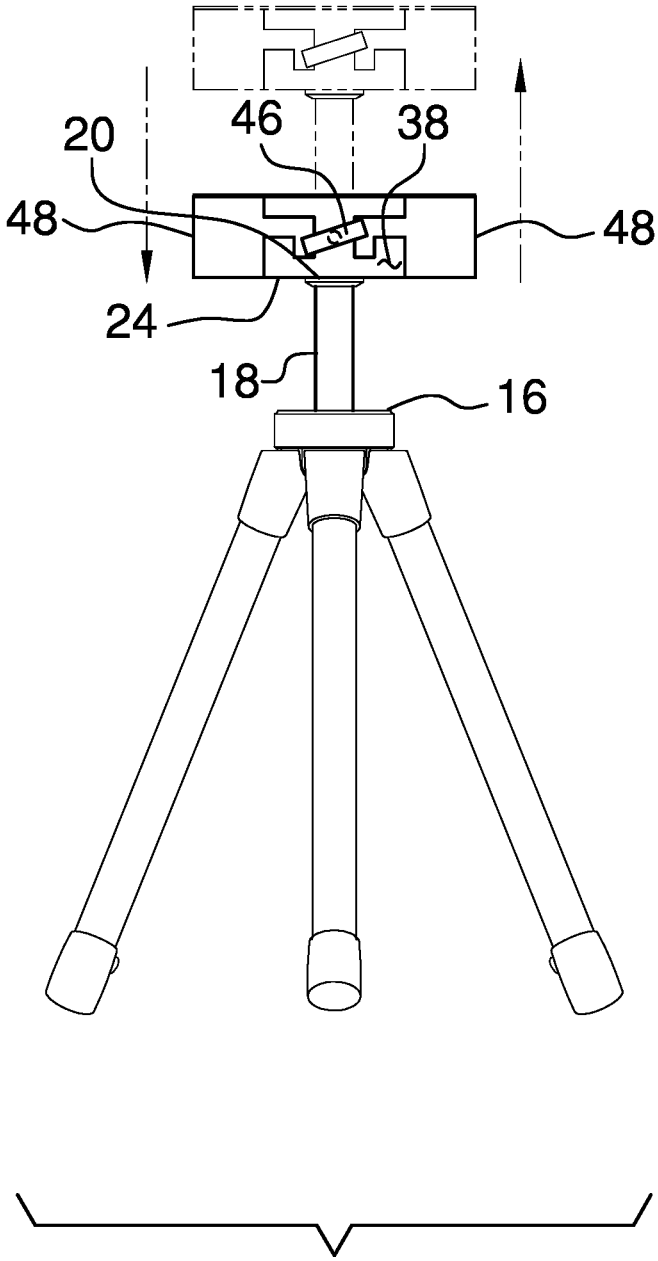
FIG. 4 is a back view of an embodiment of the disclosure.
Figure 5:
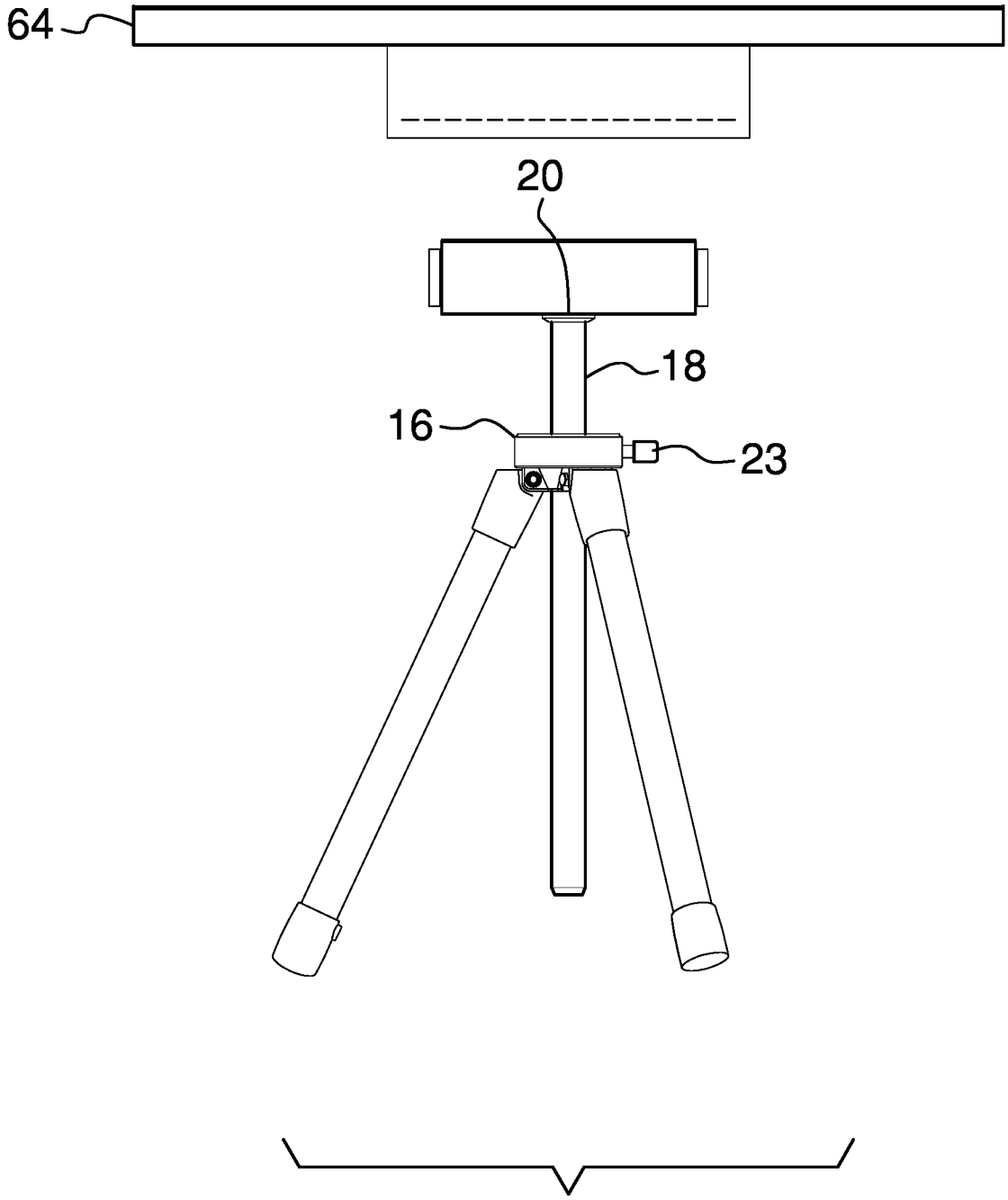
FIG. 5 is a right side view of an embodiment of the disclosure showing a plate being lowered onto a mounting block.
Figure 6:
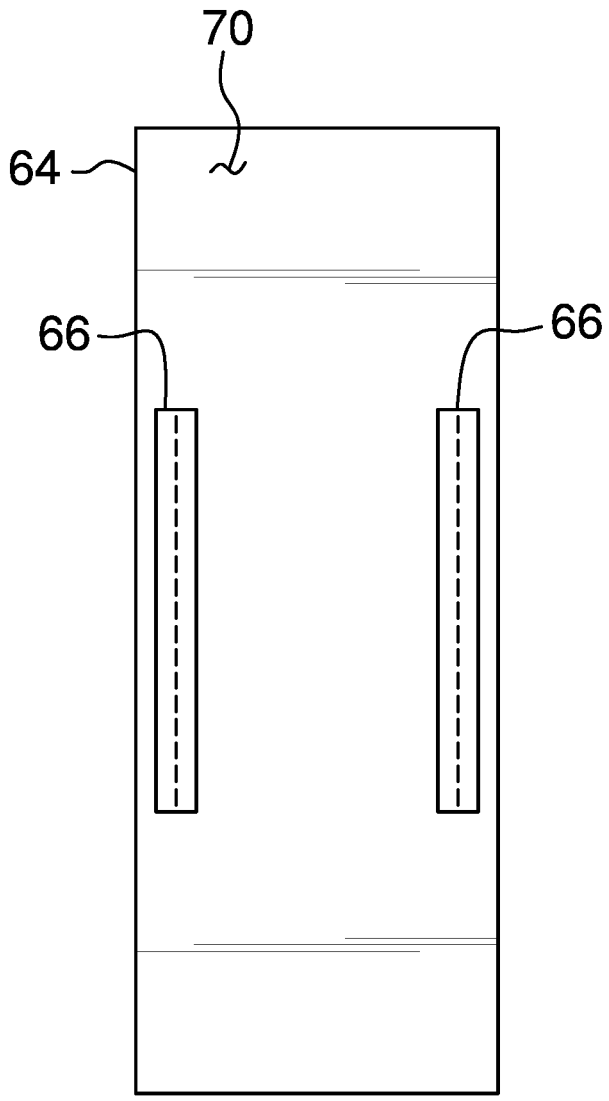
FIG. 6 is a bottom view of a plate of an embodiment of the disclosure.

With reference now to the drawings, and in particular to FIGS. 1 through 6 thereof, a new support device embodying the principles and concepts of an embodiment of the disclosure and generally designated by the reference numeral 10 will be described.

As best illustrated in FIGS. 1 through 6, the painting support assembly 10 generally comprises a tripod 12 which has a plurality of legs 14 that is each pivotally coupled to a collar 16 and a stanchion 18 that is slidably disposed in the collar 16. The stanchion 18 has a top end 20 and the stanchion 18 has a plurality of holes 22 each extending through the stanchion 18. The holes 22 are spaced apart from each other and are evenly distributed along a substantial length of the stanchion 18. The tripod 12 has a stanchion lock 23 that is movably integrated into the collar 16 and the stanchion lock 23 releasably engages a respective one of the holes 22 in the stanchion 18 for retaining the stanchion 18 at a selected height.

A mounting block 24 is coupled to the stanchion 18 and the mounting block 24 has a pair of channels 26 that is each integrated into the mounting block 24. The mounting block 24 has a top surface 28, a bottom surface 30, a first lateral surface 32, a second lateral surface 34, a front surface 36 and a back surface 38, and the mounting block 24 is elongated between the front surface 36 and the back surface 38. Each of the channels 26 extends into a respective one of the first lateral surface 32 and the second lateral surface 34, and each of the channels 26 extends through the front surface 36 and the back surface 38. Additionally, each of the channels 26 has a first portion 40 extending toward a center of the mounting block 24 and a second portion 42 extending toward the bottom surface 30 such that each of the channels 26 has an L-shape. A pad 44 is coupled to and completely covers the top surface 28 of the mounting block 24 and the pad 44 is comprised of a friction inhibiting material, including but not being limited to, felt, cotton or other similar material. The mounting block 24 may have a length of approximately 7.0 inches and a width of approximately 3.5 inches.

A pair of knobs 46 is provided and each of the knobs 46 is rotatably coupled to a respective one of the front surface 36 and the back surface 38 of the mounting block 24, and each of the knobs 46 is positioned between the pair of channels 26. Each of the knobs 46 is rotatable into a locking position having each of the knobs 46 extending laterally across the first portion 40 of each of the channels 26. Conversely, each of the knobs 46 is positionable in a releasing position having each of the knobs 46 being displaced from each of the channels 26.

A pair of extension blocks 48 is provided and each of the extension blocks 48 has an engagement 50 which extends laterally away from the extension blocks 48. The engagement 50 on each of the extension blocks 48 slidably engages a respective one of the channels 26 in the mounting block 24 such that each of the extension blocks 48 increases an overall width of the mounting block 24. In this way the mounting block 24 can support a small panel 52 in a horizontal position to facilitate painting the small panel 52. The small panel 52 may be a cabinet door or other panel of similar dimensions. Each of the extension blocks 48 may have a length of approximately 7.0 inches and width of approximately 3.5 inches. In this way the mounting block 24 and the pair of extension blocks 48 form a square of approximately 7.0 inches by 7.0 inches.

Each of the extension blocks 48 has an upper surface 54 and a first sidelong surface 56. The engagement 50 on each of the extension blocks 48 comprises a leg 58 extending away from the first sidelong surface 56 and a foot 60 extending downwardly from the leg 58 having the foot 60 being spaced from the first sidelong surface 56. The leg 58 of each engagement 50 slidably engages the first portion 40 of a respective one of the channels 26. The foot 60 of each engagement 50 slidably engages the second portion 42 of a respective one of the channels 26 to laterally restrain each of the extension blocks 48 on the mounting block 24.

A pad 62 is coupled to and completely covers the upper surface 54 of each of the extension blocks 48 and the pad 62 on the upper surface 54 is comprised of a friction inhibiting material, including but not being limited to, felt, cotton or other similar 30 material. The upper surface 54 of each of the extension blocks 48 lies on a plane that is coplanar with the top surface 28 of the mounting block 24 when the engagements 50 are engaged to the respective channel. Additionally, each of the engagements 50 has a length is equal to the length of the mounting block 24. Each of the knobs 46 is positioned in the locking position when the engagements 50 are engaged to the respective channel 26 to inhibit the engagements 50 from being removed from the respective channel 26.

A plate 64 is provided, a pair of grips 66 is each attached to the plate 64 and the plate 64 is positionable on top of the extension blocks 48 and the mounting block 24. In this way the plate 64 can support a large panel 67 in a horizontal position to facilitate painting the large panel 67. The large panel 67 may be a door for a house or other similarly sized panel. Each of the grips 66 engages a respective one of the extension blocks 48 when the plate 64 is attached to the mounting block 24. The plate 64 may have a length of approximately 24.0 inches and a width of approximately 9.0 inches.

The plate 64 has a topmost surface 68 and a lowermost surface 70, and each of the grips 66 comprises a leg 72 extending downwardly from the lowermost surface 70 and a foot 74 extending away from the leg 72 having the foot 74 of each of the grips 66 being spaced from the lowermost surface 70. Each of the grips 66 extends along opposite sides of the plate 64 from each other and the foot 74 of each of the grips 66 is directed toward each other. Each of the extension blocks 48 is positioned between the foot 74 of a respective one of the grips 66 and the lowermost surface 70 when the grips 66 engage the extension blocks 48. A pad 76 is coupled to and completely covers the topmost surface 68 of the plate 64 and the pad 76 on the topmost surface 68 is comprised of a friction inhibiting material, including but not being limited to, felt, cotton or other similar material. In this way each of the small panel 52 and the large panel 67 are inhibited from being scratched or damaged when either the small panel 52 or the large panel 67 is positioned for painting.

In use, each of the extension blocks 48 is attached to the mounting block 24 and the stanchion 18 is positioned at a desired height. In this way the small panel 52 can be laid flat on the extension blocks 48 to facilitate the small panel 52 to be painted. The plate 64 can be positioned on the mounting block 24 such that each of the grips 66 engages a respective extension block 48. In this way the overall length and width of the mounting block 24 and the extension blocks 48 is increased to facilitate the large panel 67 to be supported for painting. Additionally, the horizontal orientation of the small panel 52 or the large panel 67 facilitates the small panel 52 or the large panel 67 to be painted without the risk of runs and other flaws that frequently occur while painting a vertical surface or an inclined surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A painting support assembly for supporting a panel in a horizontal orientation for painting the panel, said assembly comprising:

a tripod having a plurality of legs each being pivotally coupled to a collar and a stanchion being slidably disposed in said collar;

a mounting block being coupled to said stanchion, said mounting block having a pair of channels each being integrated into said mounting block;

a pair of extension blocks, each of said extension blocks having an engagement extending laterally away from said extension blocks, said engagement on each of said extension blocks slidably engaging a respective one of said channels in said mounting block such that each of said extension blocks increases an overall width of said mounting block wherein said mounting block is configured to support a smaller panel in a horizontal position to facilitate painting the smaller panel; and a plate having a pair of grips each being attached to said plate, said plate being positionable on top of said extension blocks and said mounting block wherein said plate is configured to support a larger panel in a horizontal position to facilitate painting the larger panel, each of said grips engaging a respective one of said extension blocks when said larger panel is attached to said plate.

2. The assembly according to claim 1, wherein said mounting block has a top surface, a bottom surface, a first lateral surface, a second lateral surface, a front surface and a back surface, said mounting block being elongated between said front surface and said back surface, each of said channels extending into a respective one of said first lateral surface and said second lateral surface, each of said channels extending through said front surface and said back surface.

3. The assembly according to claim 2, Wherein each of said channels has a first portion extending toward a center of said mounting block and a second portion extending toward said bottom surface such that each of said channels has an L-shape.

4. The assembly according to claim 2, further comprising a pair of knobs, each of said knobs being rotatably coupled to a respective one of said front surface and said back surface of said mounting knob, each of said knobs being positioned between said pair of channels.

5. The assembly according to claim 4, wherein each of said knobs is rotatable into a locking position having each of said knobs extending laterally across a first portion of each of said channels, each of said knobs being positionable in a releasing position having each of said knobs being displaced from each of said channels.

6. The assembly according to claim 5, wherein each of said knobs is positioned in said locking position when said engagements are engaged to said respective channel to inhibit said engagements from being removed from said respective channel.

7. The assembly according to claim 1, wherein each of said extension blocks has an upper surface and a first sidelong surface, said engagement on each of said extension blocks comprising a leg extending away from said first sidelong surface and a foot extending downwardly from said leg having said foot being spaced from said first sidelong surface.

8. The assembly according to claim 7, wherein:

each of said channels has a first portion and a second portion; and said foot of each of said engagements slidably engages said second portion of a respective one of said channels, said leg of each of said engagements slidably engaging said first portion of a respective one of said channels.

9. The assembly according to claim 7, Wherein said upper surface of each of said extension blocks lies on a plane being coplanar with a top surface of said mounting block When said engagements are engaged to said respective channel.

10. The assembly according to claim 1, wherein said plate has a topmost surface and a lowermost surface, each of said grips comprising a leg extending downwardly from said lowermost surface and a foot extending away from said leg having said foot of each of said grips being spaced from said lowermost surface.

11. The assembly according to claim 10, wherein each of said grips extends along opposite sides of said plate from each other, said foot of each of said grips being directed toward each other.

12. The assembly according to claim 10, wherein each of said extension blocks is positioned between said foot of a respective one of said grips and said lowermost surface when said grips engage said extension blocks.

13. A painting support assembly for supporting a panel in a horizontal orientation for painting the panel, said assembly comprising:

a tripod having a plurality of legs each being pivotally coupled to a collar and a stanchion being slidably disposed in said collar, said stanchion having a top end, said stanchion having a plurality of holes each extending through said stanchion, said holes being spaced apart from each other and being evenly distributed along a substantial length of said stanchion, said tripod having a stanchion lock being movably integrated into said collar, said stanchion lock releasably engaging a respective one of said holes in said stanchion for retaining said stanchion at a selected height;

a mounting block being coupled to said stanchion, said mounting block having a pair of channels each being integrated into said mounting block, said mounting block having a top surface, a bottom surface, a first lateral surface, a second lateral surface, a front surface and a back surface, said mounting block being elongated between said front surface and said back surface, each of said channels extending into a respective one of said first lateral surface and said second lateral surface, each of said channels extending through said front surface and said back surface, each of said channels having a first portion extending toward a. center of said mounting block and a second portion extending toward said bottom surface such that each of said channels has an L-shape;

a pair of knobs, each of said knobs being rotatably coupled to a respective one of said front surface and said back surface of said mounting knob, each of said knobs being positioned between said pair of channels, each of said knobs being rotatable into a locking position having each of said knobs extending laterally across said first portion of each of said channels, each of said knobs being positionable in a releasing position having each of said knobs being displaced from each of said channels;

a pair of extension blocks, each of said extension blocks having an engagement extending laterally away from said extension blocks, said engagement on each of said extension blocks slidably engaging a respective one of said channels in said mounting block such that each of said extension blocks increases an overall width of said mounting block wherein said mounting block is configured to support a smaller panel in a horizontal position to facilitate painting the smaller panel, each of said extension blocks having an upper surface and a first sidelong surface, said engagement on each of said extension blocks comprising a leg extending away from said first sidelong surface and a foot extending downwardly from said leg having said foot being spaced from said first sidelong surface, said foot of each of said engagements slidably engaging said second portion of a respective one of said channels, said leg of each of said engagements slidably engaging said first portion of a respective one of said channels, said upper surface of each of said extension blocks lying on a plane being coplanar with said top surface of said mounting block when said engagements are engaged to said respective channel, each of said engagements having a length being equal to the length of said mounting block, each of said knobs being positioned in said locking position when said engagements are engaged to said respective channel to inhibit said engagements from being removed from said respective channel; and a plate having a pair of grips each being attached to said plate, said plate being positionable on top of said extension blocks and said mounting block wherein said plate is configured to support a larger panel in a horizontal position to facilitate painting the larger panel, each of said grips engaging a respective one of said extension blocks when said larger panel is attached to said plate, said plate having a topmost surface and a lowermost surface, each of said grips comprising a leg extending downwardly from said lowermost surface and a foot extending away from said leg having said foot of each of said grips being spaced from said lowermost surface, each of said grips extending along opposite sides of said plate from each other, said foot of each of said grips being directed toward each other, each of said extension blocks being positioned between said foot of a respective one of said grips and said lowermost surface when said grips engage said extension blocks.

* * * * *